United States Patent [19]

Braun

[11] Patent Number: 4,774,795

[45] Date of Patent: Oct. 4, 1988

[54] EXPANSION JOINT

[76] Inventor: Frank A. Braun, 119 Woodview Crescent, Kitchener, Ontario, Canada, N2A 3B1

[21] Appl. No.: 912,232

[22] Filed: Sep. 29, 1986

Related U.S. Application Data

[63] Continuation-in-part of Ser. No. 777,769, Sep. 19, 1985, abandoned, which is a continuation of Ser. No. 507,465, Jun. 24, 1983, abandoned.

[30] Foreign Application Priority Data

Jan. 31, 1983 [CA] Canada ..... 4205472

[51] Int. Cl.[4] ..... E01C 11/04

[52] U.S. Cl. ..... 52/396; 52/573; 404/68

[58] Field of Search ..... 52/573, 586, 396, 60, 52/63; 404/64, 65, 68, 69

[56] References Cited

U.S. PATENT DOCUMENTS

| | | | |
|---|---|---|---|
| 3,099,110 | 7/1963 | Spaight | 404/65 |
| 3,470,662 | 10/1969 | Kellman | 52/573 |
| 3,606,826 | 9/1971 | Bowman | 404/64 |
| 3,852,901 | 12/1974 | Woodle et al. | 52/586 |
| 3,918,824 | 11/1975 | Bowman | 404/64 |
| 3,977,802 | 8/1976 | Galbreath | 52/396 |
| 3,982,361 | 9/1976 | Deutsch et al. | 52/63 |
| 4,111,583 | 9/1978 | Brady et al. | 52/396 |
| 4,295,315 | 10/1981 | Lynn-Jones et al. | 52/573 |
| 4,338,753 | 7/1982 | Janke | 52/586 |
| 4,359,847 | 11/1982 | Schukolinski | 52/573 |
| 4,391,077 | 7/1983 | Giess | 52/586 |
| 4,447,172 | 5/1984 | Galbreath | 52/396 |
| 4,504,170 | 3/1985 | Schukolinski | 52/573 |

*Primary Examiner*—Carl D. Friedman
*Assistant Examiner*—Caroline D. Dennison
*Attorney, Agent, or Firm*—Daryl W. Schnurr

[57] ABSTRACT

An expansion joint has a seal with symmetrical ridges located on either side. One support extends on each side of the seal and each support has a base and cover that together contain a channel. Each channel is formed from a groove in each of the base and cover, each groove having side walls that continuously diverge from one another to an open face of said groove. The channel is of similar size and shape, but slightly smaller than the ridge so that each ridge is held snugly under pressure in each of the channels. The peculiar shape of the channel allows the supports to be bend in a vertical or horizontal plane while maintaining the channel intact.

19 Claims, 5 Drawing Sheets

EXPANSION JOINT

This is a continuation-in-part application of application Ser. No. 06/777,769 filed Sept. 19th, 1985, which was a continuing application of application Ser. No. 06/507,465 filed June 24th, 1983, both abandoned.

BACKGROUND OF THE INVENTION

1. Field of the Invention

This invention relates to expansion joints used in structures that are subjected to vehicular traffic, and particularly, to expansion joints used in bridges, roads, parking garages and similar structures.

2. Description of the Prior Art

It is known to have an expansion joint with a flexible seal held between two supports. However, previous expansion joints are either too difficult or expensive to install, maintain or replace; or, the supports do not exert equal pressure onto the seal during expansion; or, the sealing relationship between the seal and the support cannot be maintained for a sufficiently long period of time; or, the seal can tear or rupture due to unequal pressure being exerted on a particular part of the seal; or, the seal cannot be replaced unless the gap in which the expansion joint is located is at or near its widest distance; or, special tools are required to install the seal in the supports; or, that part of the seal located within the supports is unable to participate in the expansion of the joint; or, when the seal is under strain, the seal is not designed to evenly distribute said strain and an area of high strain is created in said seal; or, the seal contains one or more sharp re-entrant corners; or, the seal has insufficient ability to deform transversely; or, the seal is held in the supports by use of an adhesive; or, the supports cannot be readily bent sufficiently in a horizontal or vertical plane without causing the channel to collapse; or, mitreing is necessary when the expansion joint changes in a horizontal or vertical direction.

While expansion joints have been known for some time, it has only been relatively recently that the importance of expansion joints, in extending the usable life of structures in which expansion joints are installed, has been realized. When road salt continuously comes into contact with reinforced concrete supports of a structure, the supports can be severely damaged in a relatively short period of time. By having an expansion joint that has been installed properly and is in poper working order, water containing road salt can be easily drained away from the structure. Seals used in expansion joints are designed to expand laterally by an amount sufficient to cover the expansion of the joint with changes in the temperature.

As long as the seal is properly designed, it will have sufficient expansion capability to cover the maximum width of the joint. However, as the seal ages, it can become brittle and it will then break or crack as the joint expands or contracts. Also, if there are any air pockets in the seal or between the seal and supports, condensation can occur causing a buildup of moisture. If the moisture subsequently freezes, the freezing can cause the seal or the supports to crack or break. A common problem with expansion joints arises when debris, for example, road salt, stones, gravel, dirt, litter or the like accumulate in the joint on an upper surface of the seal. When the level of debris is at or near the level of a road surface where the joint is installed, as wheels of motor vehicles pass over the joint, a significant force is exerted in a downward direction transverse to the seal. If the seal is not designed to distribute this force evenly, the seal can easily be torn or otherwise irreparably damaged by the force exerted on the debris by repeated passage of motor vehicles.

Many expansion joints that are installed extend diagonally across a road surface but are normal to the edge of a sidewalk extending across a structure in which the expansion joints are installed. Thus, many expansion joints have at least two changes of direction. A vertical change of direction up a curve to a sidewalk and a horizontal change of direction between the road surface and the sidewalk. When mitreing is used for either a horizontal or vertical change in direction, the supports must be cut at an angle and various pieces of support must be cut at various angles and then welded together. In some expansion joints, the seal must be mitred as well. In addition to being very time consuming and expensive, mitreing creates a weak point or high area of strain in the expansion joint. If the mitreing is not absolutely perfect, air pockets can be created within the joint. This can cause a buildup of moisture and failure or damage when the moisture changes to ice. Also, as the mitreing is usually done along an edge of the roadway, that is usually the area where most of the water on the structure passes. A leak in that area can be much more serious than a leak in the centre of the structure. In addition, it is very labourious to mitre the supports at a sharp angle, for example, ninety degrees. Normally, previous expansion joints are not mitred at angles of more than forty-five degrees. Also, many previous expansion joints cannot be angled at all or must be angled at angles of equal to or less than forty-five degrees because the seal is too rigid or it will not fit properly in the supports when the supports are angled.

SUMMARY OF THE INVENTION

It is an object of the present invention to provide an expansion joint where strain exerted on the seal is distributed evenly throughout the seal, thereby avoiding concentrations of high strain in the seal. It is a further object of the present invention to provide an expansion joint where mitreing can be eliminated for changes in the vertical or horizontal direction of the supports for the expansion joint.

An expansion joint for use in a structure that is subjected to vehicular traffic has, in combination, a seal of solid, flexible and resilient material and two supports therefor. The seal is a single layer with a central web and two ridges that are integral with said web, said web having two parallel sides with one ridge being located along each side. Each side of said web has a transitional area immediately adjacent to said ridge, each transitional area extending between said ridge and a first curve of said web. Each ridge is symmetrical about a plane through a series of points that are equi-distant from an upper and lower surface of said web in said transitional area. Each of said supports has a base and a cover, each base and cover together containing a channel having a cross-section of slightly smaller size and similar shape to the cross-section of one ridge. Each channel is formed from a groove in each of said base and cover, each groove having side walls that continuously diverge from one another to an open face of said groove. There are releasable clamping means on each support so that the base and cover can be rigidly affixed to one another with one of the ridges being held snugly under pressure from the side walls of the channel of one support and the other ridge being held snugly under pressure from the side walls of the channel of the other support so that said ridges cannot be removed from said channels without releasing said clamping means.

BRIEF DESCRIPTION OF THE DRAWINGS

A preferred embodiment of the invention is described in the following drawings.

DESCRIPTION OF A PREFERRED EMBODIMENT

Figure 1:
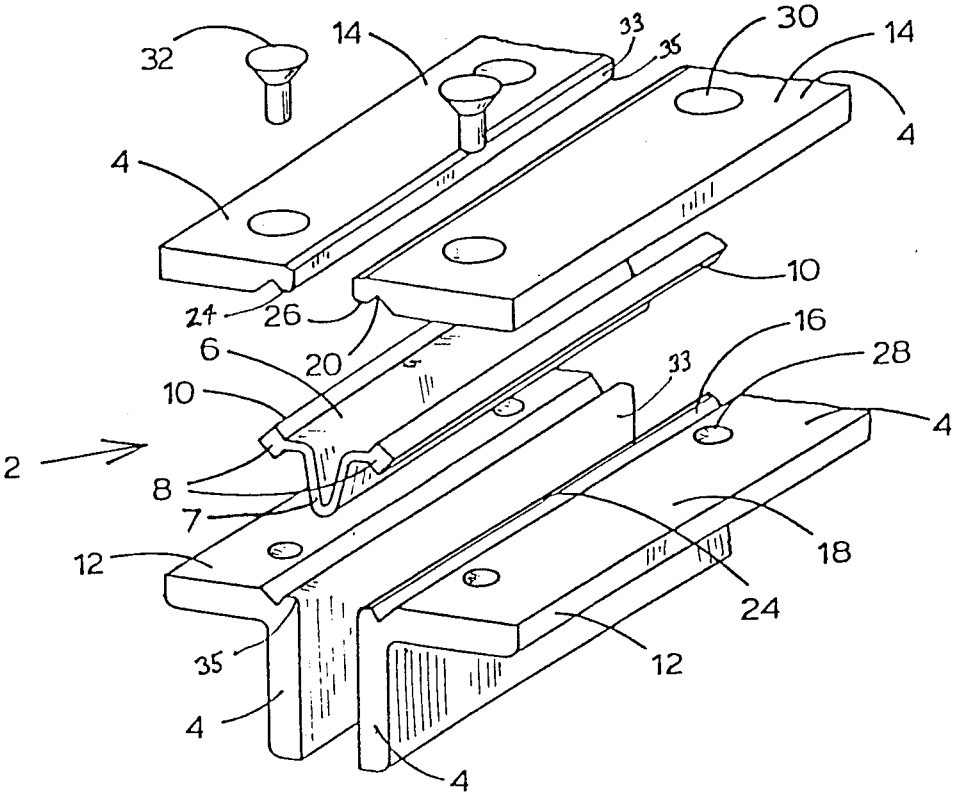
FIG. 1 is an exploded perspective view of an expansion joint having two supports and a flexible seal.

Referring to the drawings in greater detail, in FIG. 1, there is shown part of an expansion joint 2 with supports 4 and a seal 6. The seal 6 is a single layer with a central web 7 and two ridges 8 that are integral with said web 7, said web having two parallel sides 10 with one ridge being located along each side.

Each of the supports 4 has a base 12 and a cover 14 that together contain a channel having a cross-section of similar size and shape to the cross-section of one ridge 8. As shown in FIG. 1, a groove 16 located in a surface 18 of the base 12 is a mirror image of a groove 20 located in the cover 14. The two grooves 16, 20 together make up the channel. Each groove 16, 20 has a cross-section of slightly smaller size and similar shape to one-half of the cross-section of one ridge 8.

Figure 2:
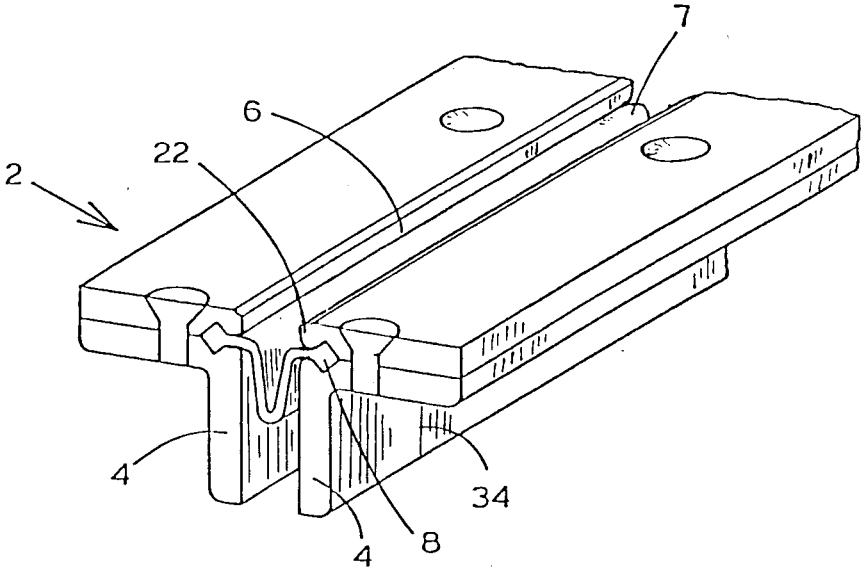
FIG. 2 is a perspective view of the expansion joint of FIG. 1.

As can be seen from FIG. 2, the channel is shaped and located so that part of a transitional area 22 of said web 7 immediately adjacent to the ridge 8 is also held within the support 4. Of course, the grooves 16, 20 are cut away at surfaces 24, 26 to allow for the area 22 of the seal 6. Each transitional area 22 of said web 7 extends between the ridge 8 and a first curve 27. Spaced openings 28, 30 in the base 12 and cover 14 respectively are designed to receive threaded cap screws 32. The openings 28, 30 and screws 32 are the releasable clamping means so that the base 12 and cover 14 of each support 4 can be rigidly affixed to one another with one of the ridges 8 held snugly under pressure within the channel of the other support 4 and the other ridge 8 held snugly under pressure within the channel of the other support 4. This can best be seen in FIG. 2. Each support 4 has an inner edge 33 with an inner corner 35 that is rounded. That part of the transitional area held within the support is held snugly but is able to move relative to the support when the seal is stretched. Similarly, each ridge is able to deform slightly when the seal is stretched. Each ridge is designed to be under pressure when held in the support to ensure that all air pockets in the channel are eliminated. Each groove 16, 20 has side walls that continuously diverge from one another to an open face of said groove.

The seal is made of a solid, flexible and resilient material. It is designed to be flexible enough to stretch, but at the same time, rigid enough so that the ridges 8 cannot be removed from the channels of the supports 4 without removing the screws 32. The screws 32 have cone-shaped or tapered heads and are counter-sunk in the supports 4. Preferably, the heads of the screws 32 are hexagonal heads.

Each of the ridges 8 has a substantially square cross-section and is joined to the transitional area 22 at what would otherwise be a corner of said square cross-section. In FIGS. 1 and 2, the base 12 of each of the supports 4 has a flange 34. Supports of this type are generally designed to be used in original or new installations of expansion joints so that the base 12 can be more firmly affixed to the bridge or structure in which the expansion joint is to be located. The two supports 4 for each expansion joint are identical to one another except that they are positioned so that one is the mirror image of the other. Of course, in manufacture, the supports are manufactured identically and simply oriented at the job site so that one fits in one side of the gap in which the expansion joint is to be installed and one fits on the other side.

While it is not essential that the grooves 16, 20 of the channel in the base 12 and cover 14 respectively be mirror images of one another, this is preferable as it can lead to cost savings in the manufacture of the parts.

Figure 3:
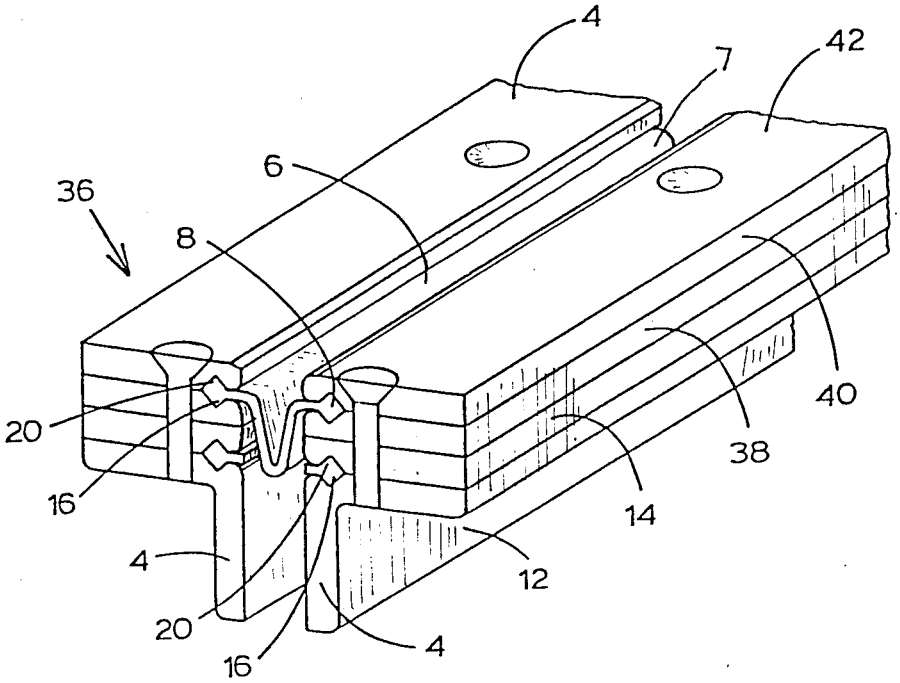
FIG. 3 is a perspective view of another embodiment of an expansion joint used to replace an existing expansion joint.

Referring to FIG. 3 in greater detail, there is shown a replacement expansion joint 36. In general terms, the expansion joint 36 is nearly identical to the expansion joint 2 shown in FIG. 1 except that a base 38 of the expansion joint 36 does not have any flange 34. When it becomes necessary to replace an existing expansion joint that was installed originally in accordance with the present invention, the screws can be removed from the spaced openings 28, 30 and the flexible seal can be removed from the channel or that part of the seal remaining between the two supports can simply be cut away. In any event, once the screws 32 have been removed, it is a relatively simple matter to install a new base 38 above the old base 12 and cover 14. A new seal 6 can then be installed in the groove 16 of the new base 38 and a new cover 40 can be inserted on top of the new base 38 to hold the ridges 8 of the seal 6 snugly under pressure within the new channel. Longer screws are then inserted into the openings 28, 30 and the new expansion joint is fully installed. In most cases, by the time the flexible seal needs to be replaced, the roadway on the bridge or structure will also need to be upgraded. As the new base 38 and the new cover 40 provide increased height for the expansion joint, the new road surface can be installed so that it is flush with the surface 42 of the cover 40. Since the grooves 16, 20 of the new base 38 and cover 40 respectively are mirror images of one another, the base 38 and cover 40 can be identical parts that simply need to be positioned so that the surfaces containing the grooves can be located adjacent to one another. Also, the base 38 and cover 40 can be identical to the cover 14 described in FIGS. 1 and 2.

Alternatively, where increased height of the expansion joint is not desired, a new flexible seal 6 can simply be installed into an existing expansion joint by loosening and removing the screws 32, removing the cover 14 and the old seal 6. A new flexible seal 6 can then be inserted onto the base 12 and the screws reinserted into the spaced openings 28, 30 so that the ridges 8 of the new seal 6 are held snugly under pressure within the channel.

Figure 4:
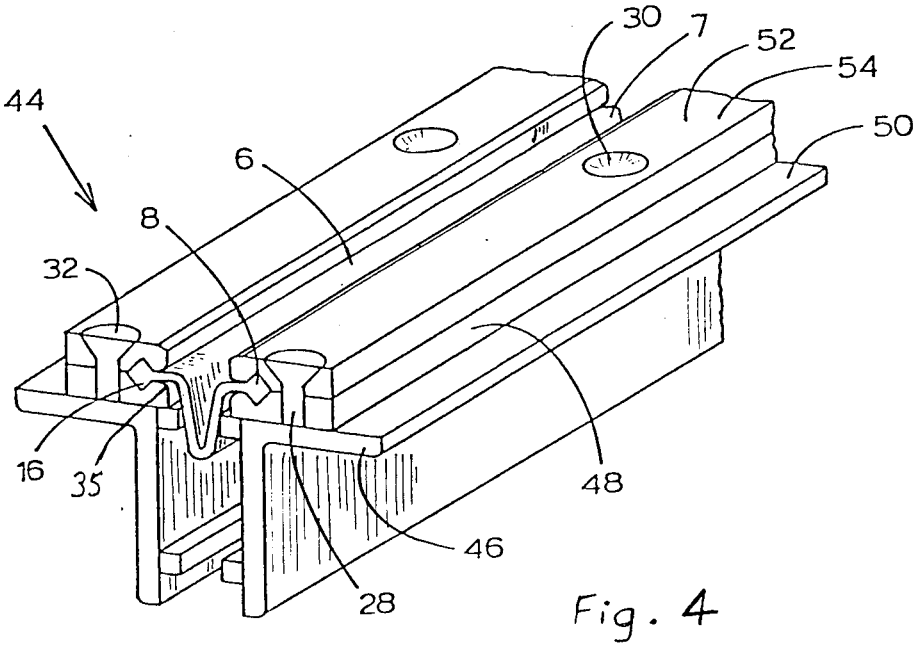
FIG. 4 is a perspective view of another embodiment of an expansion joint used to replace an existing expansion joint.

In FIG. 4, there is shown an expansion joint 44 in accordance with the present invention that has been used to replace an existing expansion joint that was not in accordance with the present invention. A support 46 is the support of the old expansion joint that is rigidly affixed to the bridge or structure in which the old expansion joint was installed. Once the old flexible seal has been removed or cut away, a new base 48 can be welded to an upper surface 50 of the old support 46. The new base 48 contains spaced openings 28 and a groove 16 in accordance with the present invention. A new flexible seal 6 having ridges 8 in accordance with the present invention is then installed into the groove 16. A new cover 52 is then installed on top of the base 48 and rigidly affixed to said base 48 by screws 32 (only part of which is shown). Since the groove 20 in the cover 52 is a mirror image of the groove 16 in the base 48, the base 48 and cover 52 can be identical parts. A new road surface can then be installed flush with the surface 54 of the cover 52.

Figure 5:
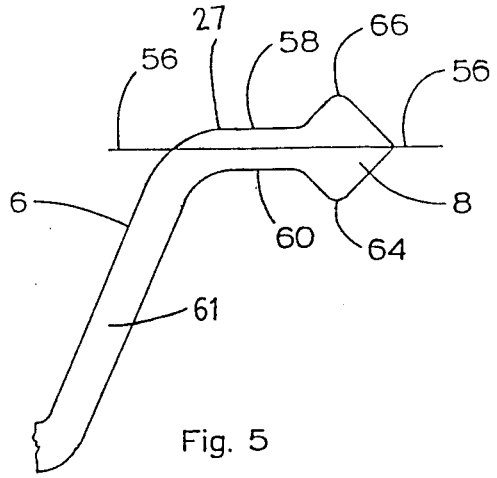
FIG. 5 is a partial schematic end view of a seal.

Referring to FIG. 5 in greater detail, there is shown a partial schematic end view of a flexible seal 6, including a transitional area 22 and a ridge 8. The ridge 8 is symmetrical about a plane 56 through a series of points that are equidistant from an upper surface 58 and a lower surface 60 of said web 7 in said transitional area 22. The ridge 8 on the opposite side of the seal 6 could be described in the same manner but is not shown in FIG. 5. The seal 6 has two members 61, (only one of which is shown in FIG. 5) each having a length that is at least equal to a factor of five times a thickness of said member 61.

Figure 6:
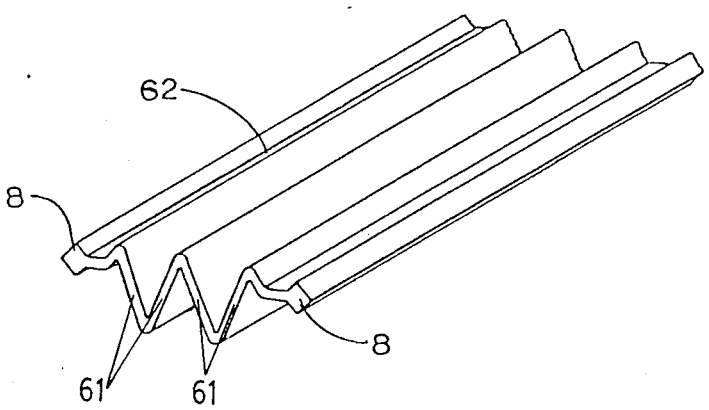
FIG. 6 is a perspective view of a seal with ridges in accordance with the present invention, said seal being used for larger gaps than the seal in the previous drawings.

In FIG. 6, there is shown a flexible seal 62 having ridges 8 that are designed in accordance with the present invention. The seal 62 has four members 61 that have a length at least equal to a factor of five times the thickness of said members. Of course, seals of various other sizes could be used in accordance with the present invention depending on the size range of the gap where the expansion joint is to be installed.

It is believed that the shape of the ridge 8 shown in the drawings is particularly efficient because it is relatively simple to manufacture and it can be easily inserted into the groove 16 during installation. Since there are points 64, 66 at the lower and upper portions respectively (see FIG. 5), it is a relatively simple task to make sure that the point 64 is located somewhere within the V-shaped groove 16. Even if the point 64 is not located properly within the channel, because of the peculiar shape of the ridge, as the cover is installed over the base, the force exerted by the two grooves 16, 20 will cause the ridge 8 to shift laterally into the correct position so that it will be held snugly under pressure in the channel of the support when the cover is rigidly affixed to the base. Since the channel is slightly smaller in size but similar in shape to the ridge, the side walls of each groove will exert pressure on the ridge contained within the channel. Also, when the ridge is properly inserted within a channel, any air pockets will be eliminated. The supports and the cap screws can be made of any suitable material, for example, steel. The V-shaped grooves can be machined into the steel or installed in any other suitable manner. The flexible seal can be made of any suitable flexible, resilient, but sufficiently rigid, material, for example, neoprene.

Figure 7:
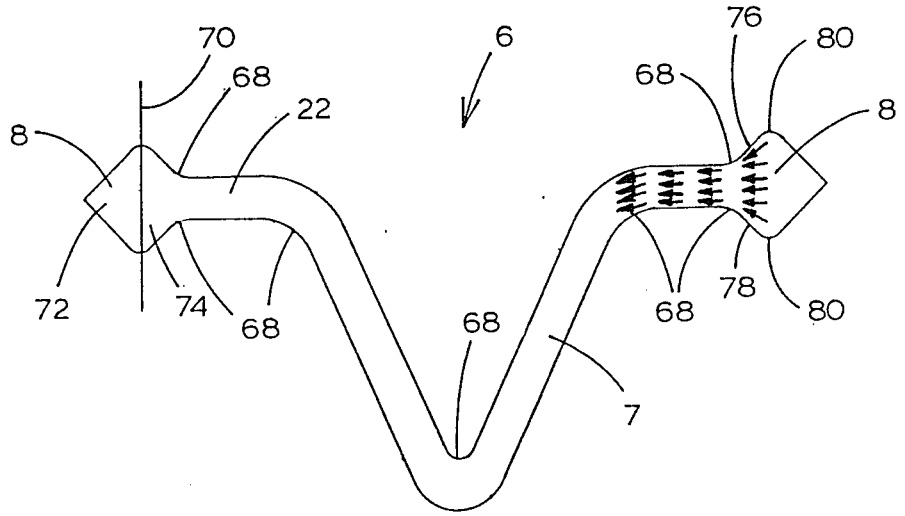
FIG. 7 is a schematic end view of a seal.

In FIG. 7, there is shown a seal 6 with a web 7 having transitional areas 22 and ridges 8 along each side. The seal 6 is shown in a rest position. All angles 68 of less than 180° between adjacent surfaces on the web 7 and between adjacent surfaces between the web 7 and each ridge 8 have a radius equal to at least a factor of one-quarter times a thickness of the seal at that particular angle. Preferably, the transitional areas 22 have a length at least equal to a factor of 1.5 times a thickness of said web 7 in said transitional area. The angles 68 are often referred to technically as re-entrant corners. Since the angles 68 are rounded and there are no sharp corners in the seal, the seal 6 has an excellent ability to deform transversely when debris builds up on top of the seal and is forced against the seal by wheels of a motor vehicle passing over the seal. Also, because all of the angles have a radius at least equal to one-quarter the thickness, deformation in unsupported portions of the seal occurs principally in a flexural mode. Hence strains at the reentrant corners of the seal are kept below levels that could cause tearing or irreparable damage.

It should be noted that there is a smooth transition at the angles 68 between the transitional area 22 and each ridge 8. Hence, at the section where the transition region joins the ridge, any strain on the seal is evenly distributed through the thickness to avoid a locally high strain and therefore the seal 6 is much less likely to tear or otherwise become seriously damaged when subjected to strain. Each ridge has an upper surface and a lower surface that smoothly diverge from one another immediately adjacent to said web. If, for example, a ridge had a circular cross-section and was affixed directly to the transitional area 22, the angle between the area 22 and the ridge would have a radius less than one-quarter the thickness, thereby creating an area of high strain along the line where the ridge joins the web. Such a seal would not be able to accommodate the same vertical loads or displacements as the seal 6 without tearing or otherwise suffering irreparable damage. The corners 35 of each support are rounded to reduce the possibilities of high strain concentrations in the seal at these corners.

The seal 6 of FIG. 7 has one ridge with an imaginary vertical plane 70 extending through a thickest part of said ridge 8. Material 72 of said ridges on a side of said plane 70 opposite to said transitional area 22 has a volume greater than seventy-five per cent of the volume of a remaining part 74 of said ridge 8. Preferably, the cross-sectional shape of the ridge 8 is square with the transitional area 22 joined to the ridge at what would otherwise be a corner of said square cross-section. However, material 72 on a side of the plane 70 opposite to the transitional area 22 can be any reasonable compact shape as long as it constitutes at least seventy-five per cent of the volume of the remainder part 74 of the ridge 8.

One of the ridges 8 of FIG. 7 has a series of arrows located thereon to indicate the directional movement of material as strain is exerted on the seal. For ease of illustration, the movement of material indicated by the arrows is greatly exaggerated over the movement that in fact occurs. The material between a thickest part of the ridge moves towards the web in essentially the same plane as pressure is exerted on said ridge from said transitional area. In fact, the component of displacement normal to the plane 70 of any point within the ridge and transitional area is essentially the same as that of those points about and below it on a plane parallel to the plane 70. Each ridge has an upper surface 76 and a lower surface 78 that smoothly diverge from one another immediately adjacent to said web 7. For ease of manufacture, the corners 80 at the thickest part of each ridge 8 are rounded.

Figure 8:
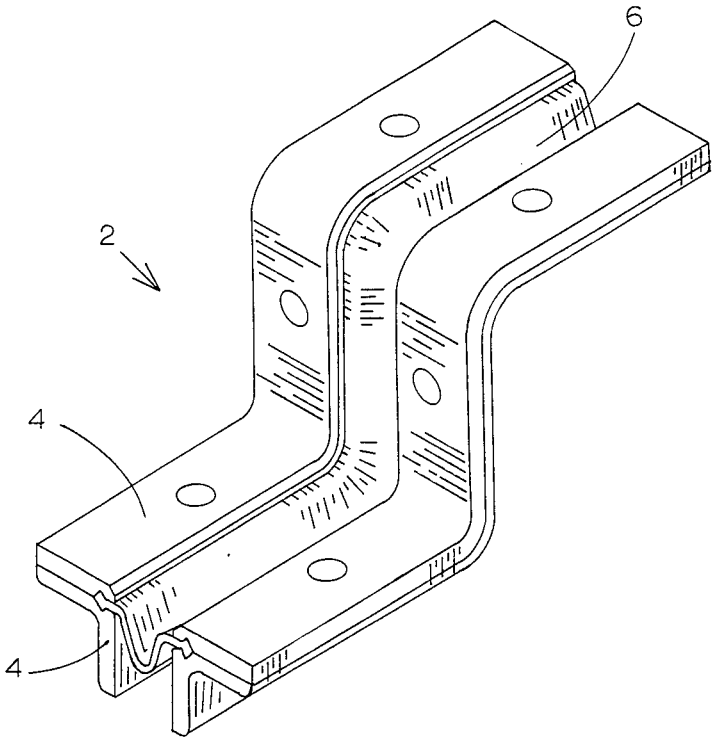
FIG. 8 is a partial perspective view of an expansion joint with a vertical change in direction therein.

In FIG. 8, there is shown an expansion joint 2 with the seal 6 held in supports 4. The expansion joint has two vertical changes in direction, one change from the horizontal to the vertical and another from the vertical to the horizontal. It can be seen that the supports are bent to form these turns and no mitreing is used in either the seal or the supports. The vertical change in direction can be used in an expansion joint that extends from a roadway up a curb and then along a sidewalk. It has been found that the minimum radius of the vertical turns is approximately two inches.

Figure 9:
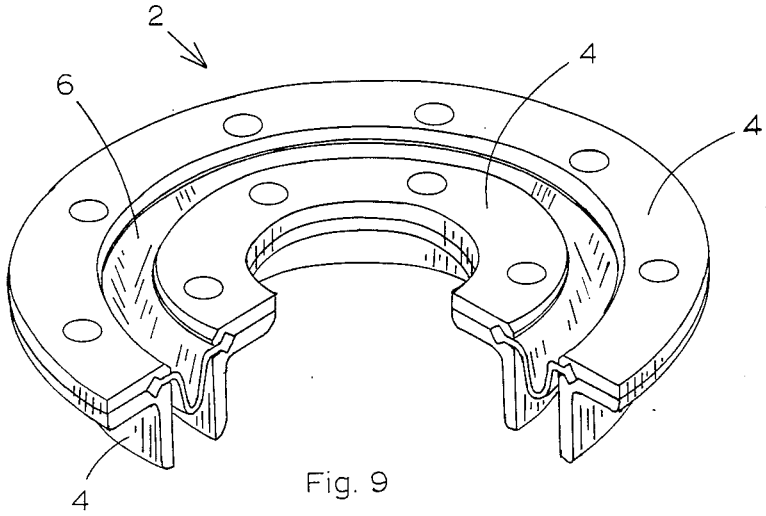
FIG. 9 is a partial perspective view of an expansion joint with a horizontal change of direction therein.

In FIG. 9, there is shown an expansion joint 2, where the seal is mounted in supports 4 that have been bent in a horizontal direction. As can be seen, the expansion joints forms part of a circle. It has been found that the minimum radius of the horizontal turn is approximately two feet. The horizontal turn shown in FIG. 9 can be used when it is necessary to have the expansion joint change directions in a horizontal plane. Of course, in some installations, it will be necessary to use combinations of FIGS. 8 and 9 where the expansion joint changes direction vertically and horizontally simultaneously. In either FIG. 8 or 9, the channel remains intact after the bending operation has been performed. There is no mitreing used in either the supports or the seal. The supports 4 and the seal 6 are formed in one piece, without any welding or cutting being necessary. Two ways in which the supports 6 can be bent or curved is through heating or cold-forming. During either of these bending operations, a square bar, of the same size and shape as the channel is inserted into the channel and the base and cover are clamped together. After the bending operation has been completed, the clamps can be released and the square bar can be removed from the channel without any difficulty. During the bending operation, the bar prevents the channel from collapsing or becoming otherwise distorted. The oblique or diverging sides of each groove of the channel allow the easy removal of the bar. As the supports are bent, force is exerted by the side walls of each groove against the bar. The bar causes the channel to remain intact during the bending operation. The oblique or diverging side walls of each groove prevent the bar from becoming wedged in the channel. As additional force is exerted on the bar during the bending operation, the force tends to urge the bar towards the open face of each groove and the bar is therefore easily removable from the channel when the two supports are unclamped.

As can be seen from FIGS. 8 and 9, the relatively sharp turns of the supports enables a base and cover of each support, each being one piece, to extend up a curb and along a sidewalk at an edge of the roadway. Also, if an expansion joint extends obliquely across a roadway structure from one edge of the roadway to the other, the two sections of roadway on either side of the expansion joint will each have a sharper corner of much less than ninety degrees. The sharp corner can give rise to an area of weakness in the roadway structure as usually a vertical support is not located directly beneath the sharp corner. With the expansion joint of the present invention, the gap between two adjacent roadway structures can extend obliquely across the roadway portion of each structure and then extend normal to the edges across the sidewalks or side portions of each structure.

What I claim as my invention is:

1. An expansion joint for use in a structure that is subjected to vehicular traffic, said expansion joint comprising in combination, a seal of solid, flexible and resilient material and two supports therefor, said seal being a single layer with a central web and two ridges that are integral with said web, said web having two parallel sides with one ridge being located along each side, each side of said web having a transitional area immediately adjacent to said ridge, each transitional area extending between said ridge and a first curve of said web, each ridge being symmetrical about a plane through a series of points that are equidistant from an upper and lower surface of said web in said transitional area, each of said supports having a base and a cover, each base and cover together containing a channel having a cross-section of slightly smaller size and similar shape to the cross-section of one ridge, each channel being formed from a groove in each of said base and cover, each groove having side walls that continuously diverge from one another to an open face of said groove, with releasable clamping means on each support so that the base and cover can be rigidly affixed to one another with one of the ridges held snugly under pressure from the side walls of the channel of one support and the other ridge held snugly under pressure from the side walls of the channel of the other support, said ridges being rigid enough that they cannot be removed from said channels without releasing said clamping means.

2. An expansion joint as claimed in claim 1 wherein the transitional areas each have a length equal to at least a factor of 1.5 times a thickness of said web in said transitional area, all angles of less than 180° between adjacent surfaces on the web and adjacent surfaces between the web and each ridge having a radius equal to at least a factor of one-quarter times a thickness of the seal at that angle, each ridge being flexible enough so that it can deform slightly when the seal is stretched.

3. An expansion joint as claimed in claim 2 wherein each ridge is shaped so that material initially between a thickest part of said ridge remains essentially on a common imaginary plane which moves towards said web as pressure is exerted on said ridge from said transitional area.

4. An expansion joint as claimed in claim 3 wherein the web of the seal has two members that each have a length that is at least equal to a factor of 5 times a thickness of said members.

5. An expansion joint as claimed in claim 4 wherein each ridge is divided along an imaginary vertical plane extending through a thickest part of said ridge, material on a side of said plane opposite to said transitional area has a compact configuration and a volume greater than seventy-five percent of a volume of material on a remaining part of said ridge.

6. An expansion joint as claimed in claim 5 wherein the ridge has a square cross-section and is joined to said transitional area at what would otherwise be a corner of said square cross-section.

7. An expansion joint as claimed in claim 1 wherein each ridge has an upper and lower surface that smoothly diverge from one another immediately adjacent to said web.

8. An expansion joint as claimed in claim 7 wherein each ridge has a substantially square cross-section and is joined to the transitional area at what would otherwise be a corner of said square cross-section and each groove is substantially V-shaped.

9. An expansion joint as claimed in claim 8 wherein corners of said square cross-section at a thickest part of each ridge are rounded.

10. An expansion joint as claimed in any one of claims 1, 4 or 8 wherein a groove in the base of the support is a mirror image of a groove in the cover of said support, each groove having a cross-section of slightly smaller size and similar shape and being nearly equal to the cross-section of one-half of the cross-section of one ridge.

11. An expansion joint as claimed in any one of claims 1, 4 or 8 wherein the base and cover contain suitable openings and there are screws for insertion into said openings to hold the base firmly against the cover.

12. An expansion joint as claimed in any one of claims 1, 4 or 8 wherein the channel is shaped and located so that part of a transitional area of said seal is also held within said support.

13. An expansion joint as claimed in any one of claims 1, 4 or 8 wherein bolts are used to releasably clamp the cover and base of said support to one another and said bolts have tapered heads.

14. An expansion joint as claimed in any one of claims 1, 4 or 8 wherein the base and cover of each support are identical to one another.

15. An expansion joint as claimed in any one of claims 1, 4 or 8 wherein an inner corner along an inner edge of each support is rounded.

16. An expansion joint as claimed in any one of claims 1, 4 or 8 wherein the base and cover of the supports are each one piece and are bent through a curve in a vertical direction.

17. An expansion joint as claimed in any one of claims 1, 4 or 8 wherein the base and cover of the supports are each one piece and are bent through a curve in a vertical direction and the minimum radius of the curve is two inches.

18. An expansion joint as claimed in any one of claims 1, 4 or 8 wherein the base and cover of the supports are each one piece and are formed in a curve in a horizontal direction.

19. An expansion joint as claimed in any one of claims 1, 4 or 8 wherein the base and cover of the supports are each one piece and are formed in a curve in a horizontal direction, said curve having a minimum radius of two feet.

* * * * *